US006416337B1

(12) United States Patent
Fan

(10) Patent No.: US 6,416,337 B1
(45) Date of Patent: Jul. 9, 2002

(54) CONNECTOR ASSEMBLY

(75) Inventor: Chia Hao Fan, Shu-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/715,572

(22) Filed: Nov. 17, 2000

(30) Foreign Application Priority Data

Oct. 9, 2000 (TW) ..... 089217538

(51) Int. Cl.[7] ..... H01R 13/44
(52) U.S. Cl. ..... 439/135; 439/940
(58) Field of Search ..... 439/135, 940, 439/148, 149

(56) References Cited

U.S. PATENT DOCUMENTS 4,938,714 A * 7/1990 Kawai et al. ..... 439/135
5,249,977 A * 10/1993 Tanaka et al. ..... 439/135

* cited by examiner

*Primary Examiner*—Tulsidas Patel
*Assistant Examiner*—Phuong KT Dinh
(74) *Attorney, Agent, or Firm*—Wei Te Chung

(57) ABSTRACT

An electrical connector assembly includes an electrical connector (1) and a vacuum suction cover (3) secured on the electrical connector. The electrical connector has an insulating housing (10), a shielding shell (2) shielding the insulating housing, and a first and a second terminals (11,12) received in the housing and contacting each other. An annular space (4) is defined between an inner periphery of the shielding shell and an outer periphery of the insulating housing. The vacuum suction cover has an upper head (31) with a smooth top surface (33) for being easily engaged by a suction mechanism, and a lower skirt (32) extending downwardly from the upper head. The skirt is interferentially fitted into the annular spade for securing the vacuum suction cover onto the electrical connector.

13 Claims, 4 Drawing Sheets

CONNECTOR ASSEMBLY

FIELD OF THE INVENTION

The present invention generally relates to an electrical connector assembly, and particularly to an electrical connector assembly having a vacuum suction cover for transferring and positioning an electrical connector during assembly.

BACKGROUND OF THE INVENTION

Vacuum suction mechanisms are well known in the electronic assembly art for retrieving electronic components, such as connectors, from a supply source and then transferring them by applying negative air pressure to the connectors and placing them onto a printed circuit board in a pre-selected position for soldering.

Conventional connector assemblies disclosed in U.S. Pat. Nos. 4,396,245, 5,242,311, 5249,977, 5,681174 and 5,613,864 have vacuum suction mechanisms. The vacuum suction mechanisms are engaged with the connector by frictional force between the vacuum suction mechanisms and conductive terminals. The connectors are transferred and positioned with the aid of suction force acting on the vacuum suction mechanisms. However, there is the possibility that the terminals will be damaged due to the frictional forces, resulting in adverse effects on signal transmission.

Another type of conventional connectors with vacuum suction mechanisms are disclosed in U.S. Pat. Nos. 5,688,133, 5,361,492, and 5,026,295. Both the connectors and the vacuum suction mechanisms have mating latching mechanisms for engaging the vacuum suction mechanisms with the connectors. Again, the connectors can be transferred and positioned by suction force acted on the vacuum suction mechanisms. However, because of the small size of the connectors, the latching mechanisms of both the vacuum suction mechanisms and the connectors need a high mating precision, and therefore the manufacturing operation becomes difficult and the manufacturing cost increases accordingly.

BRIEF SUMMARY OF THE INVENTION

An object of the present invention is to provide a connector assembly having a vacuum suction cover removably mounted to a connector for precisely positioning the connector.

Another object of the present invention is to provide an easily manufactured connector assembly protecting terminals of a connector from being damaged during a transferring process.

An electrical connector assembly according to the present invention includes an electrical connector and a vacuum suction cover. The electrical connector has a substantially cylindrical insulating housing, a shielding shell shielding the insulating housing, and a first and a second terminals received in the housing. An annular space is defined between an inner periphery of the shielding shell and an outer periphery of the insulating housing. The vacuum suction cover has an upper head, and a lower skirt projecting downwardly from the upper head for interferentially fitting into the annular space. The upper head has a smooth top surface for being easily engaged by a suction mechanism to complete a convenient and reliable transferring and positioning.

DETAILED DESCRIPTION OF THE INVENTION

Figure 1:
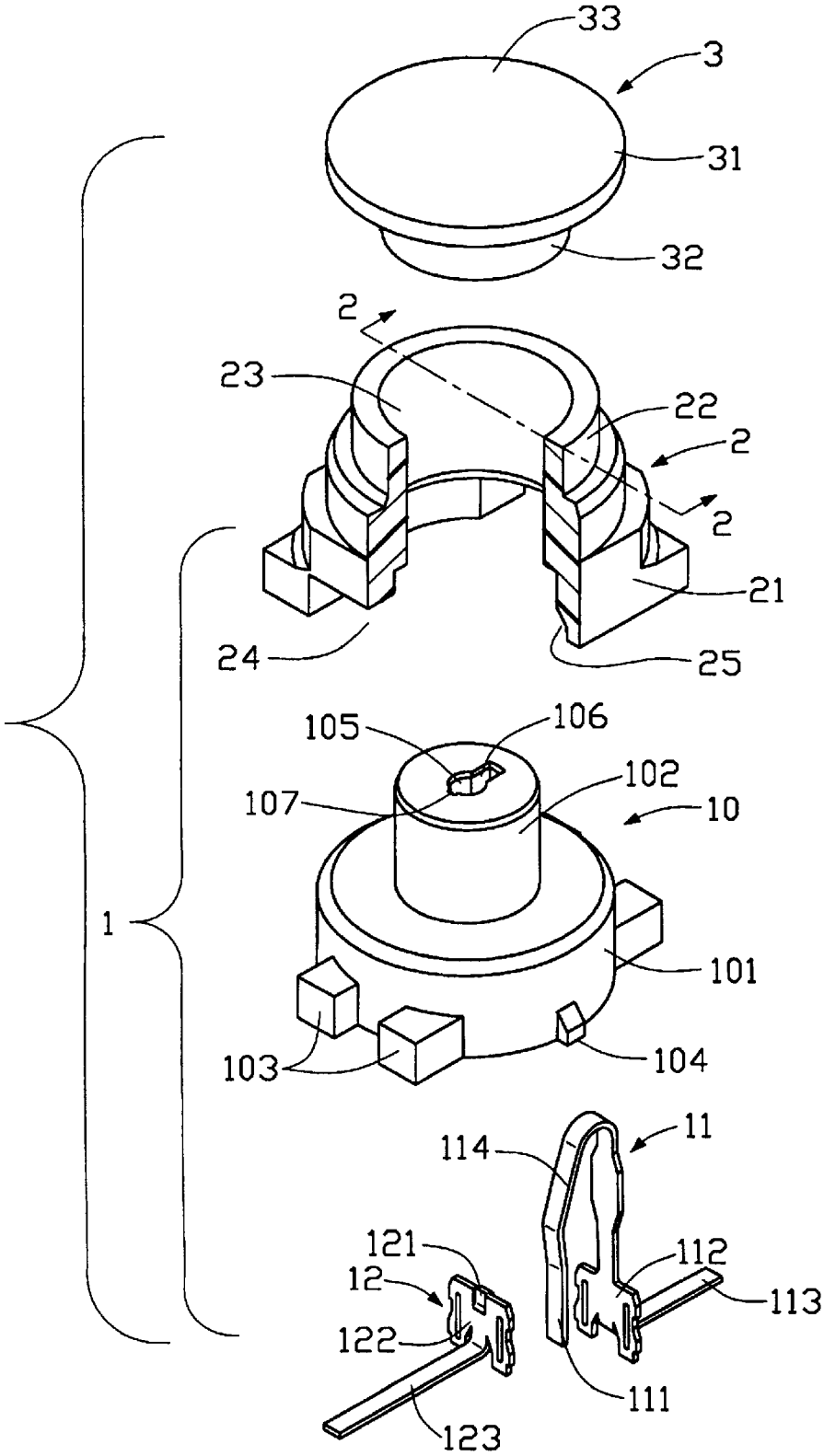
FIG. 1 is an exploded view of a connector assembly of the present invention.
Figure 2:
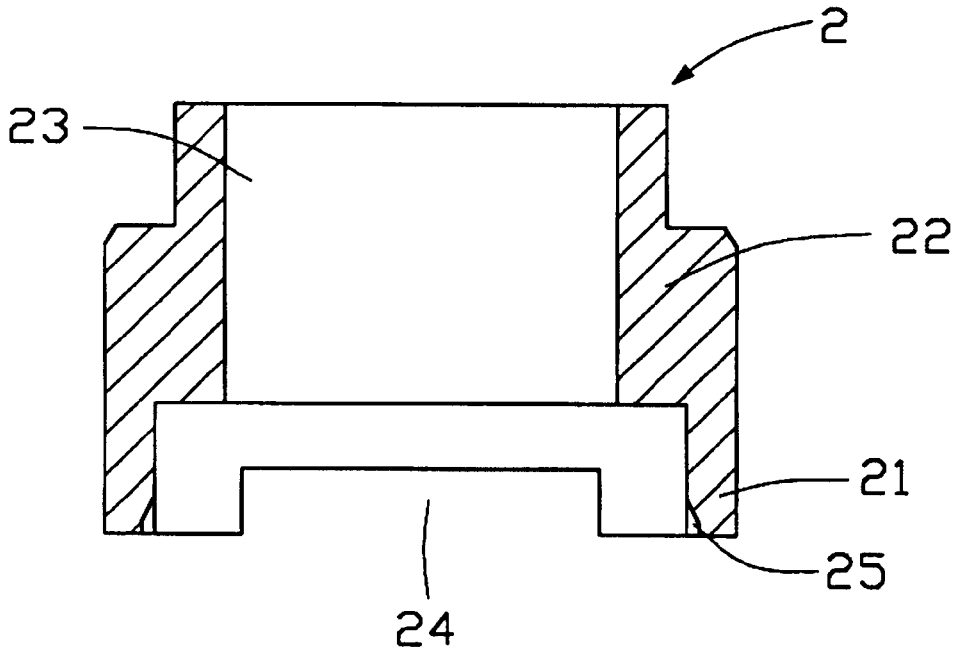
FIG. 2 is a cross-sectional view of a shielding shell of a connector of the connector assembly taken along line 2–2 in FIG. 1.

Referring to FIGS. 1 and 2, an electrical connector assembly according to the present invention has an electrical connector 1 and a vacuum suction cover 3 for use in transferring and positioning the electrical connector 1 to or on a desired location. The electrical connector 1 has an insulating housing 10, a shielding shell 2 shielding the housing 10, and a first and a second terminals 11, 12 disposed in the housing 10. The insulating housing 10 has a cylindrical base portion 101 and a cylinder 102 upwardly projecting from the base portion 101. The cylinder 102 has a common center line with the base portion 101 and a smaller diameter than the base portion 101. Two pairs of locating blocks 103 extend outwardly injuxtaposition from opposite sides of a bottom of the base portion 101 for positioning the shielding shell 2. A pair of diametrically opposed tabs 104 extend outwardly from the bottom of the base portion 101 for securing the shielding shell 2 to the housing 10. A through hole 105 is axially defined through the cylinder 102 and the base portion 101. A first passageway 106 and a second passageway 107 are defined through the cylinder 102 and the base portion 101 in communication with the through hole 105 for respectively receiving the first and the second terminals 11,12.

Figure 4:
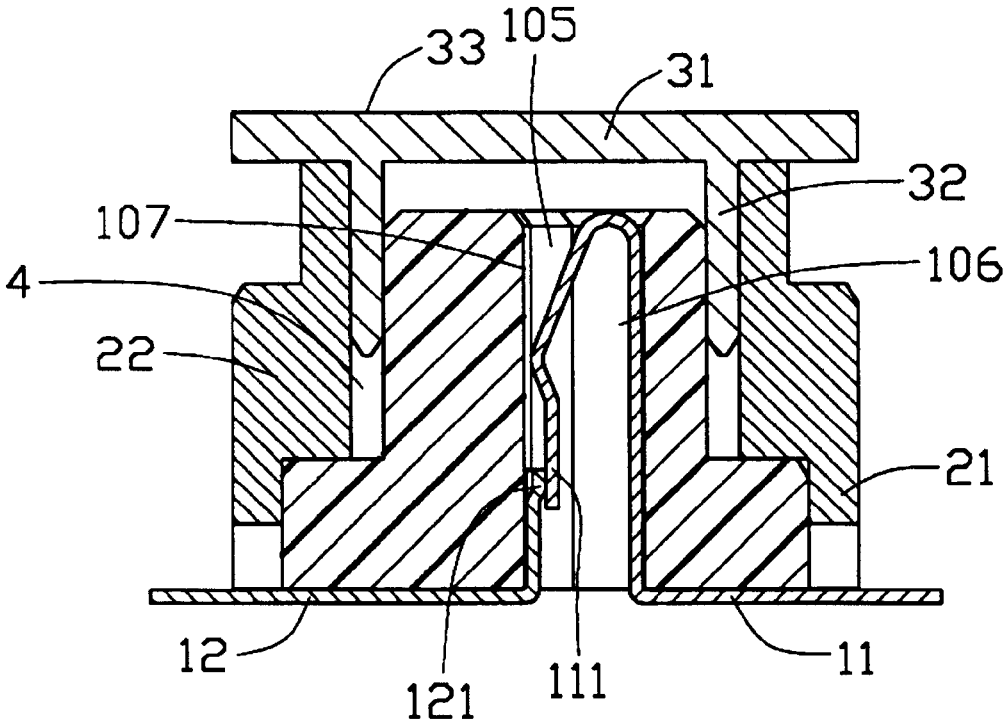
FIG. 4 is a cross-sectional view of FIG. 3 taken along line 4–4.

Referring to FIGS. 1 and 4, the first terminal 11 is stamped from a metal sheet and has a retention portion 112, a resilient portion 114 bent from a top edge of the retention portion 112, a contact portion 111 extending downwardly from a free end of the resilient portion 114, and a solder tail 113 perpendicularly extending from a lower end of the retention portion 112 opposite the resilient portion 114. The second terminal 12 is stamped from a metal sheet and has a retention portion 122, a contact portion 121 protruding from an upper portion of the retention portion 122, and a solder tail 123 extending perpendicularly from a lower portion of the retention portion 122.

Referring again to FIGS. 1 and 2, the shielding shell 2 has a substantially rectangular base 21 and a cylindrical sleeve 22. A cavity 23 is axially defined through the base 21 and the cylindrical sleeve 22. The cavity 23 is bounded by an inside wall of the shell 2 which is configured in the shape of steps to fit the profile of the insulating housing 10. A channel 24 is defined through a bottom of each of two opposite sides of the base 21 in communication with the cavity 23. A pair of cutouts 25 are defined in the bottom of the base 21 in communication with the cavity 23.

Figure 3:
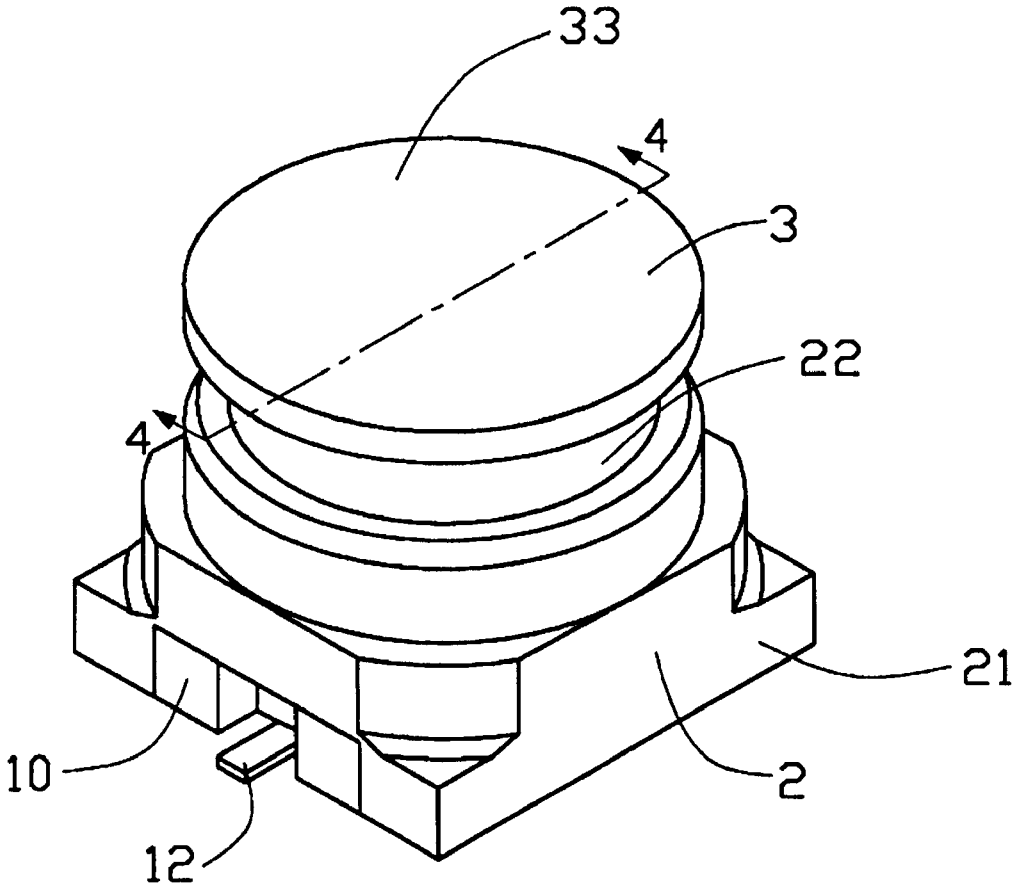
FIG. 3 is an assembled view of FIG. 1.

Referring to FIGS. 1, 3 and 4, the vacuum suction cover 3 has an upper head 31 and a lower skirt or insert 32 extending downwardly from the upper head 31. The upper head 31 is provided with a smooth top surface 33 for being easily sucked by a suction mechanism (not shown).

Particularly referring to FIGS. 3 and 4, in assembly, the first and the second terminals 11, 12 are inserted into the hole 105 from the bottom of the housing 10 to be respectively received in the first and the second passageways 106, 107. The first and the second contact portions 111, 121 electrically contact each other when no mating connector is connected with the electrical connector 1. The shielding shell 2 is then mounted on the insulating housing 10. The channels 24 of the shielding shell 2 receive the locating blocks 103, and the cutouts 25 interferentially engage with the tabs 104. An annular space 4 is defined between an inner periphery of the shielding shell 2 and an outer periphery of the cylinder 102 of the insulating housing 10. The lower skirt 32 of the vacuum suction cover 3 is interferentially fitted into the annular space 4. Thus, the vacuum suction cover 3 is secured to the connector 1. A suction mechanism known in this art can be employed to suck (draw a vacuum against) the smooth top surface 33 to complete a convenient and reliable transferring and positioning. The first and second terminals 11, 12 are protected from being damaged by the vacuum suction cover 3 because the vacuum suction cover 3 does not engage with them.

With the vacuum suction cover 3 removed, when an external electronic apparatus (not shown), such as a probe or a mating electrical connector, is inserted downwardly into the housing 10 through the hole 105, the contact portion 111 is displaced away from the contact portion 121. An electrical connection is formed between the contact portion 111 and the external electronic apparatus or the mating electrical connector for completing certain predetermined functions, such as signal detection or transmission.

It will be understood that the invention may be embodied in other special forms without departing from the spirit or central characteristic thereof. The present examples and embodiment therefore are to be considered in all respects as illustrative and not restrictive, and the invention is not to be limited to the details given herein.

What is claimed is:

1. An electrical connector assembly comprising:

an electrical connector having an insulating housing and a shielding shell enclosing about the housing, the shielding shell having a substantially rectangular base and a cylindrical sleeve projecting from the base, an annular space being defined between the insulating housing and the cylindrical sleeve; and a vacuum suction cover having a smooth top surface for being easily sucked by a suction mechanism and a lower skirt for being interferentially fitted into said annular space.

2. The electrical connector according to claim 1, wherein said insulating housing has a cylindrical base portion and a cylinder projecting from the base portion, and wherein said annular space is defined between the cylindrical sleeve of the shielding shell and the cylinder.

3. The electrical connector assembly according to claim 2, wherein the cylindrical base portion of the insulating housing has two pairs of locating locks extending outwardly in juxtaposition from opposite sides of a bottom thereof, and wherein a channel is defined at each of two opposite sides of a bottom of the base of the shielding shell for receiving the locating blocks.

4. The electrical connector assembly according to claim 2, wherein the cylindrical base portion of the insulating housing has a pair of tabs extending outwardly from a bottom thereof, and wherein the base of the shielding shell has a pair of cutouts in an inner periphery of a bottom thereof for interferentially receiving the tabs.

5. An electrical connector assembly comprising:

an insulating housing receiving terminals therein;

a shielding shell shielding the housing; and a vacuum suction cover having an upper head and a lower skirt interferentially fitted between the insulating housing and the shielding shell for transferring and positioning the housing.

6. The electrical connector according to claim 6, wherein the lower skirt extending downwardly from the upper head for interferentially fitting into the space.

7. The electrical connector assembly according to claim 5, wherein a space is defined between the shielding shell and an outer periphery of the insulating housing.

8. The electrical connector assembly according to claim 7, wherein the upper head has a smooth top surface for being easily manipulated.

9. The electrical connector assembly according to claim 7, wherein said insulating housing has a cylindrical base portion and a cylinder projecting from the base portion.

10. The electrical connector assembly according to claim 9, wherein said shielding shell has a substantially rectangular base and a cylindrical sleeve projecting from the base, and wherein the cylindrical sleeve so accommodates the cylinder of the insulating housing as to leave said space for interferentially receiving the lower skirt of the vacuum suction cover.

11. The electrical connector assembly according to claim 10, wherein the cylindrical base portion of the insulating housing has two pairs of locating blocks extending outwardly in juxtaposition from a bottom thereof, and wherein a channel is defined through a bottom of the base of the shielding shell for receiving the locating blocks.

12. The electrical connector assembly according to claim 10, wherein the cylindrical base portion of the insulating housing has a pair of tabs extending outwardly from bottom thereof, and wherein the base of the shielding shell has a pair of cutouts in an inner periphery of a bottom thereof for interferentially receiving the tabs.

13. An electrical connector assembly comprising:

an electrical connector including an insulative housing with locating blocks and contacts thereabouts, and a shielding shell enclosing the housing and defining channels through which the blocks and contacts extend outwardly, said shielding shell defining a vertical cylindrical cavity; and a vacuum suction cover including an upper head fully covering said cylindrical cavity in a vertical direction, and a lower insert downwardly extending from said upper head; wherein said lower insert is dimensioned to be circumferentially interferentially fit within said cylindrical cavity.

* * * * *